United States Patent [19]

Gambopoulos et al.

[11] 4,147,614

[45] Apr. 3, 1979

[54] AQUEOUS MIXTURE OF DIESEL OIL, PINE OIL AND DIAMINE FOR CONDITIONING OF CRUSHED MAGNESITE ORE IN MAGNETIC BENEFICIATION PROCESS

[76] Inventors: Theodor Gambopoulos, Xenokratous 37; Antonios Frangiskos, Serifou 18, both of Athens, Greece

[21] Appl. No.: 814,039

[22] Filed: Jul. 8, 1977

Related U.S. Application Data

[63] Continuation-in-part of Ser. No. 803,642, Jun. 6, 1977, abandoned.

[30] Foreign Application Priority Data

Jun. 10, 1976 [GR] Greece ..... 50954

[51] Int. Cl.$^2$ ..... B03C 1/00

[52] U.S. Cl. ..... 209/8; 209/214

[58] Field of Search ..... 209/3.4, 8, 9, 214, 209/166, 39

[56] References Cited

U.S. PATENT DOCUMENTS

| | | | |
|---|---|---|---|
| 3,179,250 | 4/1965 | Burg | 209/166 |
| 3,265,211 | 8/1966 | Ray | 209/166 |
| 3,768,646 | 10/1973 | Grannen | 209/166 |
| 3,910,836 | 10/1975 | Raby | 209/166 |
| 3,926,789 | 12/1975 | Shubert | 209/8 |
| 3,929,627 | 12/1975 | Frangiskos | 29/214 X |
| 3,974,067 | 8/1976 | Nolt | 209/166 |

*Primary Examiner*—Robert Halper

*Attorney, Agent, or Firm*—Watson, Cole, Grindle & Watson

[57] ABSTRACT

A process for the beneficiation of magnesite ores utilizes an aqueous conditioning mixture of diesel oil, pine oil and a diamine for activation of the surface of the gangue constituents so that after treatment with ferromagnetic materials, they can be easily separated from the ores by magnetic separators.

7 Claims, No Drawings

AQUEOUS MIXTURE OF DIESEL OIL, PINE OIL AND DIAMINE FOR CONDITIONING OF CRUSHED MAGNESITE ORE IN MAGNETIC BENEFICIATION PROCESS

This application is a continuation-in-part application of our application Ser. No. 803,642 filed on June 6, 1977, now abandoned entitled "A New Method for the Benefication of Ores or Minerals, with Particular Reference to Magnesite Ores."

BACKGROUND OF THE INVENTION

1. FIELD OF THE INVENTION

The present invention relates to beneficiation processes for ores or minerals, and more particularly to processes for the recovery of pure magnesite from magnesite ores containing magnesite, serpentine and other gangue materials.

2. DESCRIPTION OF THE PRIOR ART

According to our prior patent, U.S. Pat. No. 3,929,627 of Dec. 30, 1975, it is known that a mineral can be separated from its gangue, or the gangue from the mineral contained therein, by rendering in a selective manner the gangue constituents temporarily magnetic and then separating these constituents from the ore by magnetic separators. As taught in this patent, an enhancement in the magnetic behaviour of the gangue constituents to be separated can be achieved by first causing a selective activation of the surface of one or more of the gangue constituents of the ore or mineral and then coating the activated gangue constituents with a finely divided, highly magnetic substance such as magnetite or ferrosilicon, and then two concentrates can be obtained by passing the treated ore or mineral through a magnetic field (e.g. through a wet magnetic separator), i.e., so as to obtain one concentrate composed of the strongly magnetic gangue material, and one concentrate composed of the remainder material. Recovery of the finely ground magnetic material from the surface of the ore or minerals can be achieved by treatment with water under pressure, with detergents, or with agitation in another magnetic field.

The noted first step of selective activation can be achieved by initially conditioning the ore or mineral (in a crushed state) in an aqueous mixture of suitable reagents for activating the surface of the constituents to be magnetically separated, and then conditioning the crushed ore or mineral in an aqueous suspension of a finely divided, strongly magnetic material such as magnetite or ferrosilicon. The initial conditioning of the ore or mineral in order to activate the surface of the constituents to be magnetically separated is achieved, as previously noted, in an aqueous mixture of suitable reagents. According to our previous patent, a suitable aqueous mixture consisted of an aqueous suspension of, by weight, 1 percent diesel oil and 0.15 percent of a mixture of a dialkyl quaternary ammonium chloride such as ARQUAD 2C-75 and primary amines such as ARMAC T and ARMAC C.

However, it has been found that the initial aqueous conditioning mixture of our prior patent has not been found to be entirely satisfactory for a number of reasons, among them being the insufficient stability of the aqueous mixture, the high expense of producing the aqueous mixture, and the insufficient rate of activation of the surface of the constituents to be magnetically separated.

Thus, it is an object of the present invention to provide an aqueous conditioning mixture containing suitable reagents for activating the surface of the intended constituents of the magnesite ores to be magnetically separated from the remaining constituents, which mixture is considerably more stable than the aqueous conditioning mixture disclosed in U.S. Pat. No. 3,929,627.

It is furthermore an object of the present invention to provide an aqueous conditioning mixture of the foregoing type which, as compared to the mixture disclosed in our prior patent, is less expensive to produce and which can achieve the desired results using less amounts of the activating reagents therein.

It is furthermore an object of the present invention to provide an aqueous conditioning mixture of the foregoing type which, as compared to the mixture disclosed in our prior patent, includes components which adsorb or chemisorb (or both) on the particles to be separated at an appreciably faster rate (thus minimizing the required time for conditioning in the mixture); and due to the selective and fast sorption of the components onto the particles to be separated, produces particles having an increased capacity for attracting and accommodating magnetite or ferrosilicon materials. Thus, the ultimate separation efficiency of the beneficiation procedure is greatly enhanced.

SUMMARY OF THE INVENTION

According to the present invention, the aqueous mixture of reagents suitable for activating the surface of the materials to be separated consists of an aqueous solution containing diesel oil, pine oil and a diamine.

DESCRIPTION OF THE PREFERRED EMBODIMENT

In a procedure essentially identical with that followed in our noted patent, according to the present invention an ore or mineral is crushed into small particles, i.e., into particle size of less than 6 mm, and the particles are thoroughly washed. The particles having sizes of less than 0.5 mm are removed. The remaining material which contains particles with sizes of between 0.5 and 6 mm is then fed into a conditioning tank which contains an aqueous mixture of suitable reagents for activation of the surface of the constituents thereof to be magnetically removed, and agitated therein. After undergoing such conditioning the material is drained to remove the liquid and then fed into a second conditioning tank which contains a suspension of finely ground magnetite or ferrosilicon. The mixture is well stirred until the material is completely covered with magnetite or ferrosilicon.

After this further conditioning step, during which the magnetic material coates selectively the surface of the particles to be magnetically removed, the material is drained, lightly washed with water (to remove the magnetite or ferrosilicon in excess), and then fed into wet magnetic separators wherein the magnetic material is separated from the non-magnetic material.

The obtained concentrate of non-magnetic material is washed and, according to its purity, constitutes the intermediate or final product.

The magnetic material is thoroughly washed with water under pressure, or with the use of a detergent, or by agitation in a magnetic field, so that the highly magnetic material may be removed.

The inventive conditioning step, which is the step wherein the ore or mineral (such as a magnesite ore containing magnesite, slightly magnetic serpentine, non-magnetic feldspars and non-magnetic silica) is treated with reagents to activate the surface of the constituents to be magnetically removed, is accomplished in an aqueous mixture of diesel oil, pine oil and a diamine. The recovery ultimately obtained of concentrate magnetic and non-magnetic constituents will depend on the initial concentration of magnesite in the ore; however, based on each ton of feed ore, the consumption of reagents in the aqueous mixture according to the present invention is about 300 to 380 grams of diamine, about 300 to 380 grams of pine oil and about 7.7 to 8.7 liters of diesel oil. In other words, the reagents are required in only very small quantities with respect to the amounts of ore treated, i.e., smaller quantities even than the quantities used in U.S. Pat. No. 3,929,627 (300 gr/ton versus 500 gr/ton). The obtained pure magnesite will have as low a content of $SiO_2$ as 0.5 to 6% by weight, depending on the initial concentration and form of the ore. A very substantial reduction in CaO is also achieved.

The pine oil used in the aqueous conditioning mixture may be technical grade pine oil, for example, such as that sold by Hoechst A.G. under the trademark of FLOTOL B. The diamine used in the aqueous conditioning mixture may be an alkyl propylene diamine, such as the tallow derivative fatty alkyl propylene diamine of the general formula $RNHCH_2CH_2CH_2NH_2$ wherein R varies beween $C_{14}$ and $C_{18}$ sold by Hoechst A.G. under the trademark of GENAMIN TAP 100, or such as the tallow derivative alkyl propylene diamine of the general formula $RNHCH_2CH_2CH_2NH_2$ sold by Armour Hess under the trademark of DUOMEEN T.

A specific aqueous conditioning mixture which is useful according to the present invention contains, by weight, 4% diesel oil, 0.15% pine oil and 0.15% diamine.

It should be noted that although the above-described procedure according to the invention refers to the use of ore or minerals which have particle sizes from about 0.5 to 6 mm, the procedure is operative on particles having sizes of less than 0.5 mm or greater than 6 mm. In addition, the entire beneficiation procedure can be repeated on a particular concentrate obtained from a prior beneficiation procedure in order to further improve its quality. Finally, if desired the ore or mineral may be subjected to an initial mechanical preconcentration before treatment by the beneficiation process of the present invention in order to further effect a concentration of the magnesite ore or mineral.

EXAMPLE

In order to demonstrate the improved results obtained by using the aqueous conditioning mixture of the present invention as compared to the aqueous conditioning mixture according to our prior U.S. Pat. No. 3,929,627, magnesite ore samples containing, by weight, 16.92% $SiO_2$ and 4.9% CaO were subjected to the beneficiation process described in our noted patent. The aqueous conditioning mixture used in accordance with the present invention consisted by weight, of an aqueous mixture of 4% diesel oil, 0.15% technical grade pine oil and 0.15% alkyl propylene diamine. The results obtained were as follows:

| | Aqueous Mixture of Present Invention | Aqueous Mixture of U.S.P. 3,929,627 |
|---|---|---|
| Concentrate | 0.48% $SiO_2$ | 0.72% $SiO_2$ |
| | 0.88% CaO | 1.08% CaO |
| Recovery of | 85% MgO | 75% MgO |

Thus, it can be seen that use of the aqueous conditioning mixture of the present invention resulted in the recovery of a magnesite concentrate of much higher purity than the magnesite concentrate obtained when using the aqueous conditioning mixture of U.S. Pat. No. 3,929,627.

Obviously, many modifications and variations of the present invention are possible in the light of the above teachings. It is therefore to be understood that within the scope of the appended claims, the invention may be practiced otherwise than as specifically described.

We claim:

1. In a beneficiation process for the recovery of pure magnesite from magnesite ores containing magnesite, serpentine and other gangue material which includes the crushing a quantity of magnesite ore, conditioning the crushed ore to activate the surface of the serpentine and other gangue material, further conditioning the crushed ore in a suspension of a finely divided strongly ferromagnetic material so as to coat selective by the surface of the serpentine and the other gangue material as well as the strongly siliceous and carbonaceous particles of the ore, and removing the serpentine and the other gangue material as well as the strongly siliceous and carbonaceous particles of the ore from the remainder of the ore by means of a magnetic separator to obtain a concentrate of magnesite, the improvement wherein said conditioning of the crushed ore to activate the surface of the serpentine and other gangue material is accomplished by placing the crushed ore in an aqueous mixture containing diesel oil, pine oil and a diamine.

2. The process of claim 1 wherein said diamine is an alkyl propylene diamine.

3. The process of claim 2 wherein said alkyl propylene diamine is a tallow derivative alkyl propylene diamine of the general formula $RNHCH_2CH_2CH_2NH_2$ wherein R ranges from $C_{12}$ to $C_{18}$.

4. The process of claim 1 wherein the aqueous mixture contains, by weight, 4% diesel oil, 0.15% pine oil and 0.15% diamine.

5. The process of claim 1 wherein the obtained concentrate of magnesite is subjected to at least one additional beneficiation process as defined in claim 1 to obtain a higher quality concentrate.

6. The process of claim 1 wherein after crushing of the magnesite ore the ore is classified into particle size fractions of less than 0.5 mm, between 0.5 and 6 mm, and greater than 6 mm, and wherein only the fraction of between 0.5 to 6 mm is subjected to the subsequent conditioning and separation steps.

7. The process of claim 1 wherein prior to subjecting the magnesite ore to crushing, it is mechanically preconcentrated to further effect a concentrate of the magnesite.

* * * * *